US006968658B2

(12) United States Patent
Hales

(10) Patent No.: US 6,968,658 B2
(45) Date of Patent: Nov. 29, 2005

(54) REMOVABLE MULLION ASSEMBLY

(76) Inventor: Robert Norman Hales, 126 Fleming Dr., Durham, NC (US) 27712

( * ) Notice: Subject to any disclaimer, the term of this patent is extended or adjusted under 35 U.S.C. 154(b) by 143 days.

(21) Appl. No.: 10/237,342

(22) Filed: Sep. 9, 2002

(65) Prior Publication Data

US 2003/0046883 A1 Mar. 13, 2003

Related U.S. Application Data

(60) Provisional application No. 60/318,436, filed on Sep. 10, 2001.

(51) Int. Cl.[7] ..... E06B 1/04

(52) U.S. Cl. ..... 52/210; 49/7; 49/365; 292/219

(58) Field of Search ..... 52/210; 49/7, 365; 292/219

(56) References Cited

U.S. PATENT DOCUMENTS 5,794,382 A * 8/1998 Prucinsky ..... 49/365
5,890,319 A * 4/1999 Haeck et al. ..... 49/365
6,131,338 A * 10/2000 Haeck et al. ..... 49/365
6,427,387 B1 * 8/2002 Hunt ..... 49/365

* cited by examiner

*Primary Examiner*—Carl D. Friedman
*Assistant Examiner*—Yvonne M. Horton
(74) *Attorney, Agent, or Firm*—Coats & Bennett, P.L.L.C.

(57) ABSTRACT

A mullion assembly that is removably positioned within an opening. The invention includes a tube having telescoping members that fit together and are adjustable between a variety of lengths. The ends of the tube mount to first and second edges of the opening. A biasing mechanism positioned within the tube provides for adjusting the overall length of the tube. In one embodiment, a locking mechanism is located within the tube to prevent the telescoping members from moving relative to each other thus preventing the tube from being reduced in length and removed from first and second mounting assemblies and removed from the opening.

19 Claims, 7 Drawing Sheets

REMOVABLE MULLION ASSEMBLY

RELATED APPLICATION

This application claims priority benefit under 35 U.S.C. 119 from the U.S. provisional application Ser. No. 60/318,436 filed on Sep. 10, 2001, and entitled "Removable Mullion Assembly," which is incorporated in its entirety by reference herein.

BACKGROUND

Mullions may be used in a variety of situations to form a division between units of doors and windows. The term "opening" is used herein to describe the area of a door, window, or other like feature that may be divided by a mullion. The term "member" is used herein to describe the object that extends over the opening, such as but not limited to doors, windows, shutters, and the like. It is often preferable that the mullions be removable to eliminate the division of units thus providing a larger, single opening. In one common use, mullions are removed within openings to provide additional space, such as moving large objects through the doorway that otherwise would not fit through the individual divisions.

In one embodiment, mullions should be able to be removed in a straight-forward fashion, including removing the mullion in a timely manner. Additionally, removal should be convenient such that it does not require tools, ladders, etc. for the user to remove and replace the mullion. Once removed, the mullion should also be easy to replace and preferably have a positive identification such that the user is aware when the mullion is properly re-installed within the opening. Additionally, the mullion should be aesthetically pleasing.

Some prior art mullions have a single size and can only be mounted within an opening having certain dimensions. The mullions are not able to be mounted within openings of different sizes as the length would either be too short or too long to span the opening. The lack of adjustability requires mullion manufacturers to specifically make mullions for specific openings which increases the cost of the mullion, and requires the manufacturer to store additional inventory of different sizes to meet the timely demands of customers.

Removable mullions should further be secure when mounted within the opening. The mullion should provide a secure closure to prevent entry through the opening. Likewise, the mullion should be designed to prevent removal by unapproved personnel.

SUMMARY

The present invention relates to a spring-loaded removable mullion. The mullion is positioned to provide a rigid platform for mounting receptacles or brackets that receive retractable armatures extending from members mounted on the surface of the openings. The mullion can serve as a secure object to which the members may be latched, and that it may be temporarily removed so that the unpartitioned area of the opening may be increased.

DETAILED DESCRIPTION

Figure 1:
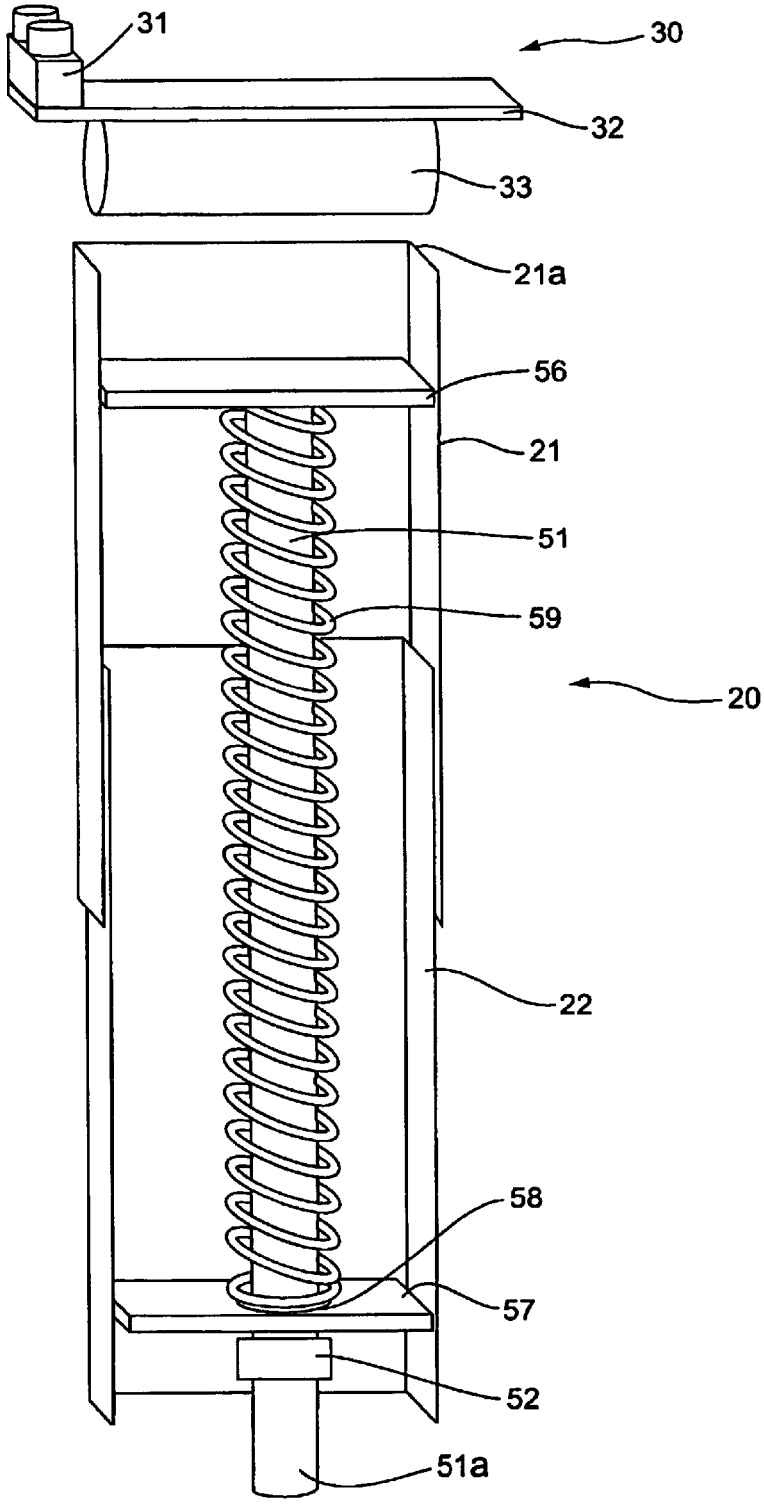
FIG. 1 is a partial cut-away perspective view of one section of the removable mullion assembly constructed according to one embodiment of the present invention.

The present invention is directed to a removable mullion assembly for positioning within an opening. The invention includes a tube 20 having telescoping members that fit together and are adjustable between a variety of lengths. A first mounting assembly 30 is mounted to a first edge 102 of the opening 100 for receiving a first end of the tube 20. A second mounting assembly 40 mounts to a second edge 102 of the opening 100 for receiving a second end of the tube 20. A biasing mechanism 59 positioned within the tube 20 provides for adjusting the overall length of the tube 20. A locking mechanism 70 is located within the tube 20 to prevent the telescoping members from moving relative to each other thus preventing the tube 20 from being reduced in length and removed from the first and second mounting assemblies 30, 40 and removed from the opening 100.

Figure 2:
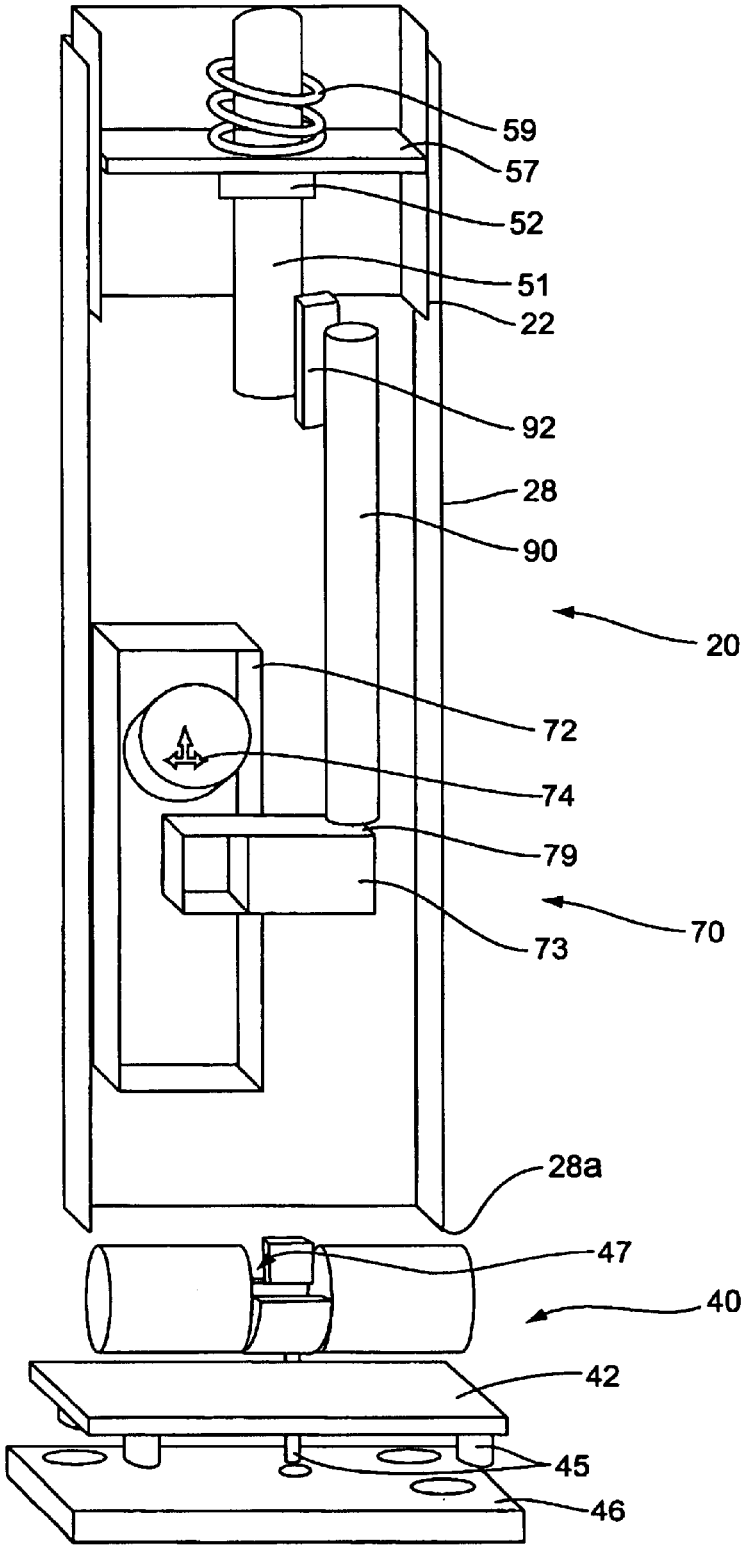
FIG. 2 is a partial cut-away perspective view of another section of the removable mullion assembly constructed according to one embodiment of the present invention.

FIGS. 1 and 2 illustrate one embodiment of the tube 20 comprising a first tube 21, second tube 22, and third tube 28. The tube 20 may have a variety of cross-sectional shapes depending upon the embodiment. In one embodiment, each of the tubes 21, 22, 28 has a substantially rectangular shape. In one embodiment first tube 21 has a hollow interior with a first end 21*a* for mounting about the first mounting assembly 30 as explained in more detail below. First tube 21 is sized to telescope with the second tube 22 thus providing for adjustment of the overall length of the tube 20.

Second tube 22 is positioned between the first tube 21 and the third tube 28. The second tube 22 may have a variety of shapes and sizes to match the other members of the tube 20. The second tube 22 acts as a guide and support for the first tube 21 during both linear motion and static position. In one embodiment, second tube 22 has a substantially rectangular cross-sectional shape with a hollow interior. In one embodiment, second tube 22 has a smaller cross-sectional shape to fit within the first tube 21. In one embodiment, second tube 22 has a smaller cross-sectional shape to fit within the third tube 28. In one embodiment, second tube 22 fits within and is rigidly connected to the third tube 28. Attachment of the second tube 22 and third tube 28 may be by a variety of manners, including welding, soldering, adhesives, and mechanical fasteners. In one embodiment, the second tube 22 is longer than the first tube 21.

Third tube 28 extends from the second tube 22 and mounts to the second mounting assembly 40. In one embodiment, third tube 28 has a hollow interior with a second end 28*a* for mounting about the second mounting assembly 40 as explained in more detail below. In one embodiment, the third tube 28 has the same shape and size as the first tube 21.

A biasing member 59 is positioned within the tube 20 to adjust the overall tube length. Biasing member 59 biases the first tube 21 outward from the second tube 22 to adjust the overall length of the tube 20. A guide rod 51 extends through a section of the tube 20. Guide rod 51 may have a variety of lengths and sizes depending upon the specific application of use. In one embodiment, guide rod 51 has a length greater than the first tube 21. In one embodiment, guide rod 51 has a length to extend through all or a portion of both the first tube 21 and the second tube 22. In one embodiment, guide rod 51 has a diameter of about ⅝ inches. In one embodiment, guide rod 51 is centered within the tube 20.

In one embodiment, a guide rod mount 56 connects the guide rod 51 to the first tube 21. In one embodiment as illustrated in FIG. 1, guide rod mount 56 is positioned at point along the first tube 21 in proximity to the end 21*a*. The guide rod mount 56 may also be positioned at a variety of locations along the length of the guide rod 21. In one embodiment, guide rod mount 56 is attached to the first tube 21 a distance from the first end 21*a* such that the first tube 21 can completely seat onto the first mounting assembly 30 as will be explained below. In one embodiment, the guide rod mount 56 is mounted about two inches from the first tube end 21*a*. Guide rod mount 56 is fixedly attached to the first tube 21 and the guide rod 51, such as by welding, soldering, adhesive, mechanical fasteners, and the like. In one embodiment, guide rod mount 56 has a shape corresponding to the cross-sectional shape of the first tube 21. In one embodiment, the guide rod mount 56 is substantially rectangular.

A guide bracket 57 is mounted within the tube 20 for positioning the guide rod 51. Guide bracket 57 may have a variety of shapes and sizes. In one embodiment, guide bracket 57 has a shape corresponding to the interior of the tube 20. In one embodiment, guide bracket 57 is substantially rectangular. In one embodiment, guide bracket 57 is mounted within the second tube 22. Guide bracket 57 includes an opening 58 through which the guide rod 51 extends. In one embodiment, opening 58 is positioned within the center of the tube 20 for centering the guide rod 51 within the tube 20. Opening 58 is sized such that the guide rod 51 can move through the guide bracket 57 during the telescoping movement.

A guide stop 52 is mounted to the guide rod 51 on an opposite side of the guide bracket 57 from the guide rod mount 56. Guide stop 52 prevents the guide rod 51 from moving beyond the guide bracket 57. The guide stop 52 extends beyond the dimensions of the guide bracket opening 57 to limit the movement of the guide rod 51 through the guide bracket 57. In one embodiment, guide stop 52 is a collar that extends around the outer edge of the guide rod 51. In another embodiment, guide stop 52 is a pin that extends through and beyond the guide rod 51. In one embodiment, the placement of the guide stop 52 on the guide rod 51 dictates the amount of extension of the first tube 21 from the second tube 22. In one embodiment, the guide stop 52 is movable along the length of the guide rod 51 to adjust the maximum overall tube length to accommodate openings 100 of different sizes.

A biasing member 59 supplies the biasing force for biasing the first tube 21 outward from the second tube 22. In one embodiment, biasing member 59 provides a force greater than the weight of the first tube 21, guide rod 51, and guide rod mount 56, and the frictional forces of the first tube 21 contacting the second tube 22. In one embodiment, biasing member 59 is positioned between the guide bracket 57 and guide rod mount 56. In one embodiment, biasing member 59 is a spring that extends around the guide rod 51. In one embodiment, the biasing member 59 is a compression spring and the guide rod 51 extends through the longitudinal axis of the compression spring. In one embodiment, biasing member 59 has a length slightly shorter than the guide rod 51.

In one embodiment in an uncompressed state, the biasing member 59 biases the first tube 21 to an extent that a section of the second tube 22 is revealed from the top of the third tube 28 to the bottom of the first tube 21. In one embodiment, the amount of compression is equal to the amount the second tube 22 is exposed in the uncompressed state because the first tube 21 contacts the third tube 28 to control the extent of compression. In one embodiment, the amount of compression is determined by the amount that the biasing member 59 can be compressed.

A locking mechanism 70 is positioned within the tube 20 to prevent relative movement of the tube members 21, 22, 28. Locking mechanism 70 controls telescoping of the tubes 21, 22, 28 by establishing a minimum length of the tube 20. The position of the locking mechanism 70 may vary over the length of the tubes 20, provided it can be positioned relative to the guide rod 51. One embodiment of the locking mechanism 70 is illustrated in FIG. 2 comprises a locking bracket 72 mounted within the tube 20. A keyhole 74 is exposed to the exterior of the tube 20 for moving an armature 73 between locked and unlocked positions. Armature 73 includes a contact surface 79 for abutting against the guide rod 51 or an extension 90. In one embodiment, the armature 73 is in an extended orientation in the locked position, and in a retracted position in the unlocked position. In the locked position, armature 73 extends with the contact surface 79 positioned within the pathway of the guide rod 51 or extension 90 to prevent axial movement of the guide rod 51 along the tube 20 to prevent telescoping movement of the tube members that shortens the overall tube length. In the unlocked position, armature 73 is moved away from the pathway of the guide rod 51 or extension 90 and the guide rod 51 can axially move thus allowing reduction in the overall tube size.

In one embodiment, guide rod 51 extends along the length of the tube 20 to contact the locking mechanism 70 to prevent telescoping movement. In another embodiment, guide rod 51 includes an extension 90 that contacts the armature 73. Extension 90 may be necessary when the locking mechanism 70 is not aligned with the guide rod 51. In one embodiment as illustrated in FIG. 2, armature 73 extends from a side of the locking bracket 72. In this embodiment, the guide rod 51 is centered within the tube 20, therefore requires an extension 90 positioned radially outward from the guide rod 51 to contact the armature 73. Additionally, an extension member 92 may further be mounted to the guide rod 51 to further move the guide rod radially such to contact the armature 73 in the locked position.

Figure 3:
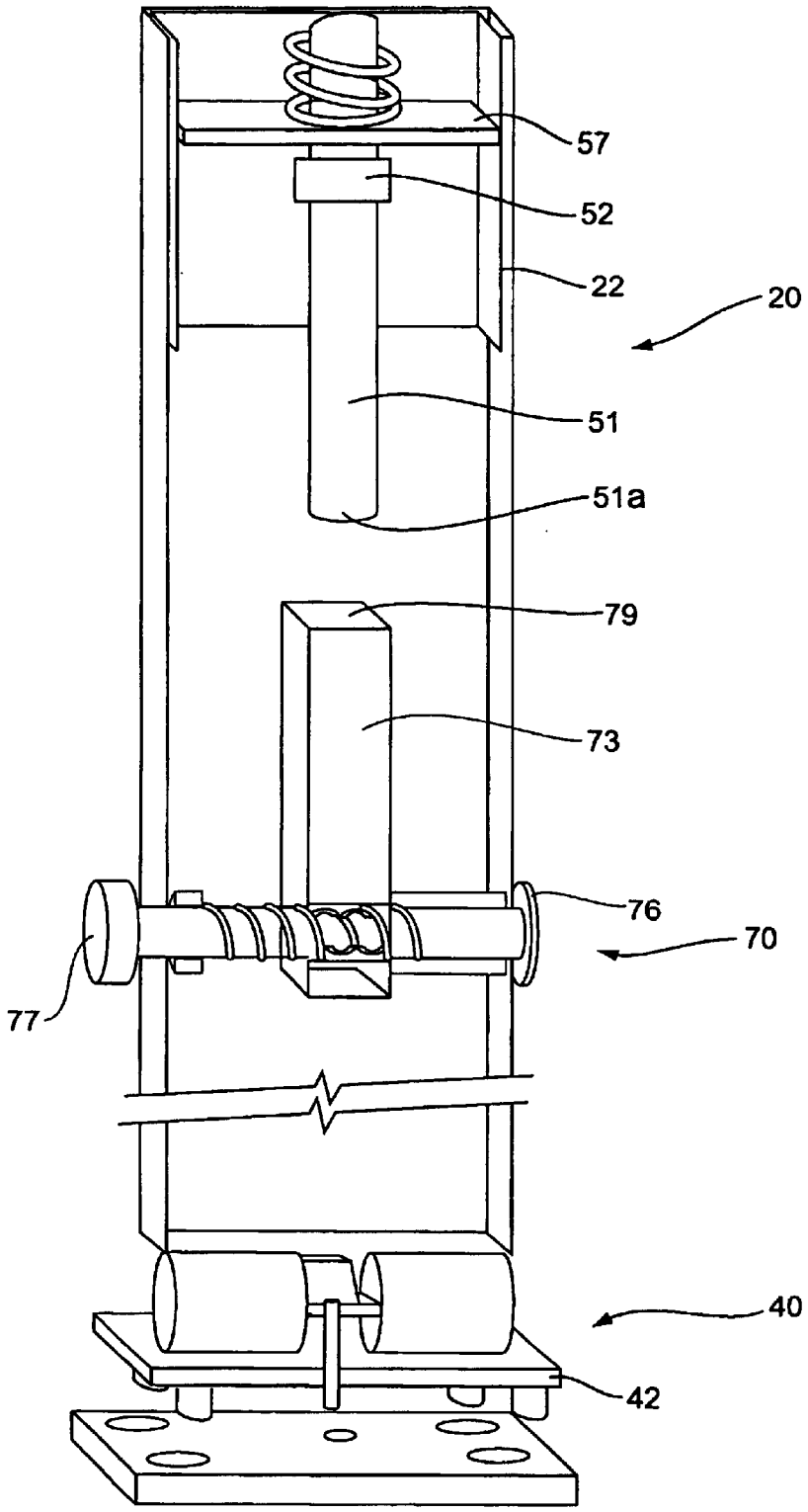
FIG. 3 is a partial cut-away perspective view of a locking mechanism constructed according to one embodiment of the present invention.

Another embodiment of the locking mechanism 70 is illustrated in FIG. 3. A member 76 extends through the tube 20 and includes a knob 77 for applying a rotating force. In one embodiment, member 76 is a ½ inch diameter threaded rod. Armature 73 having a contact surface 79 is attached to the member 76. Helical threads and grooves on the member 76 and armature 73 mate together during rotation of the member 76 causing the armature 73 to move relative to the axis of the tube 20. In a locked position, the contact surface 79 aligns with the guide rod 51 to prevent telescoping of the tube members. In an unlocked position, contact surface 79 is positioned away from the guide rod 51 thus allowing movement of the guide rod 51 beyond the contact surface 79 and telescoping of the overall length of the tube 20. The member 76 and/or knob 77 may be removable to prevent an unauthorized user from locking or unlocking the tube 20. In this embodiment, it is also understood that the guide rod 51 may include an extension 90 that abuts against the contact surface 79.

Figure 4:
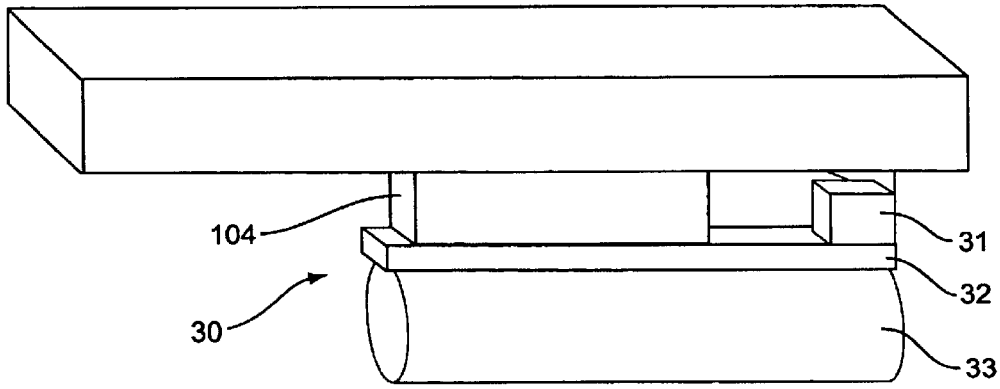
FIG. 4 is a perspective view illustrating a first mounting assembly constructed according to one embodiment of the present invention.

Mounting assemblies 30, 40 are positioned on the frame 102 of the opening 100 for receiving the tube 20. The mounting assemblies 30, 40 may have a variety of shapes and sizes depending upon the application. FIG. 4 illustrates one embodiment of a first mounting bracket 30 is comprised of bracket plate 32 for attachment to the frame 102 of the opening 100 and having a mounting stud 33 for receiving the tube 20. In one embodiment, bracket plate 32 includes apertures through which fasteners extend for mounting to the frame 102 of the opening 100. In one embodiment, opening 100 includes a threshold 104. A shim 31 extends outward from the bracket plate 32 to contact the frame 102 and more securely position the mounting bracket 30. Shim 31 may have a variety of widths to match the width of the threshold 102. Mounting stud 33 extends outward from the bracket plate 32 to mount with the tube 20. In one embodiment, mounting stud 33 is of a smaller size than the interior of the first tube 21 such that mounting stud 33 is completely received within the first tube 21. In this embodiment, the first tube end 21*a* is positioned adjacent to the bracket plate 32. In one embodiment, the first mounting bracket 30 is constructed a single unit.

Second mounting assembly 40 provides for attachment of the lower end of the tube 20 to the frame 102 opening 100 as illustrated in FIG. 2. A mounting stud 43 extends from a bracket plate 42. The mounting stud 43 is sized to connect with a lower edge of the tube 20. In one embodiment, mounting stud 43 is sized to fit within the third tube 28 such that the third tube second end 28*a* extends to the bracket plate 42. In one embodiment, the bracket plate 42 attaches directly to the opening 100. Bracket plate 42 includes one or more apertures through which fasteners 45 extend into the opening 100. In one embodiment, a mounting plate 46 is connected to the frame 102 of the opening 100 and receives the bracket plate 42. Mounting plate 46 has apertures through which the fasteners 45 extend for mounting into the frame 102 of the opening 100. In the embodiment with a mounting plate 46, bracket plate 42 and mounting stud 43 may be removed from the mounting plate 46 when the tube 20 is removed such that it does not interfere with usage of the opening 100. In one embodiment, mounting stud 43 includes an indent 47 and aperture for receiving a fastener 45.

In another embodiment of the present invention, tube 20 is constructed of two tube members. In an embodiment illustrated in FIG. 5, tube consists of first tube 120 that is sized to telescope with the second tube 130. The guide rod mount 56 is mounted within the second tube 130, and guide bracket 57 is mounted in the first tube 120. Locking mechanism 70 is positioned within the first tube 120 to control the extension movement of the guide rod 51. In one embodiment of a two-tube construction, the guide rod 51 and biasing member 59 are longer than in a three-tube construction.

Figure 5:
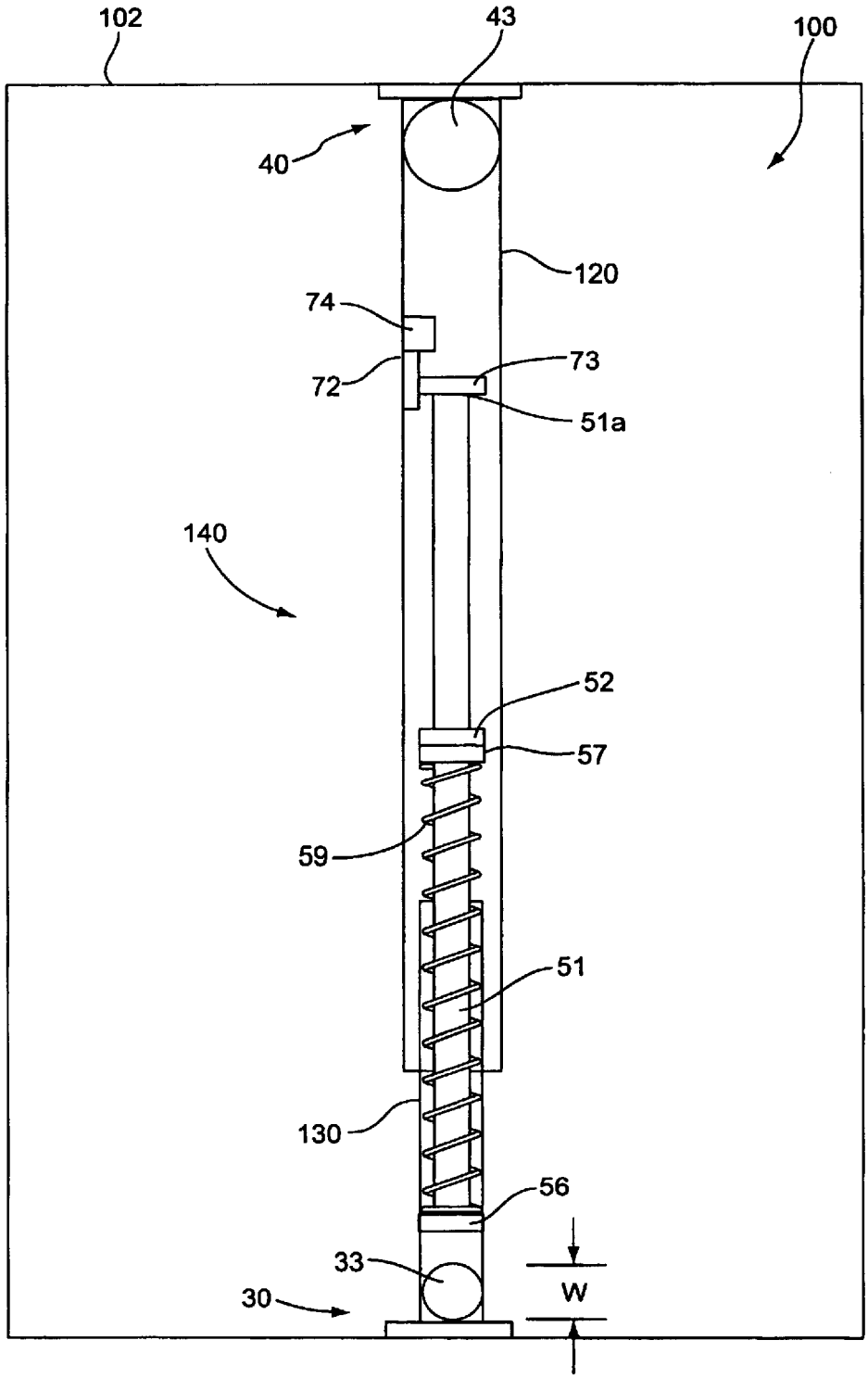
FIG. 5 is a side view illustrated one embodiment of the present invention mounted within an opening.
Figure 6:
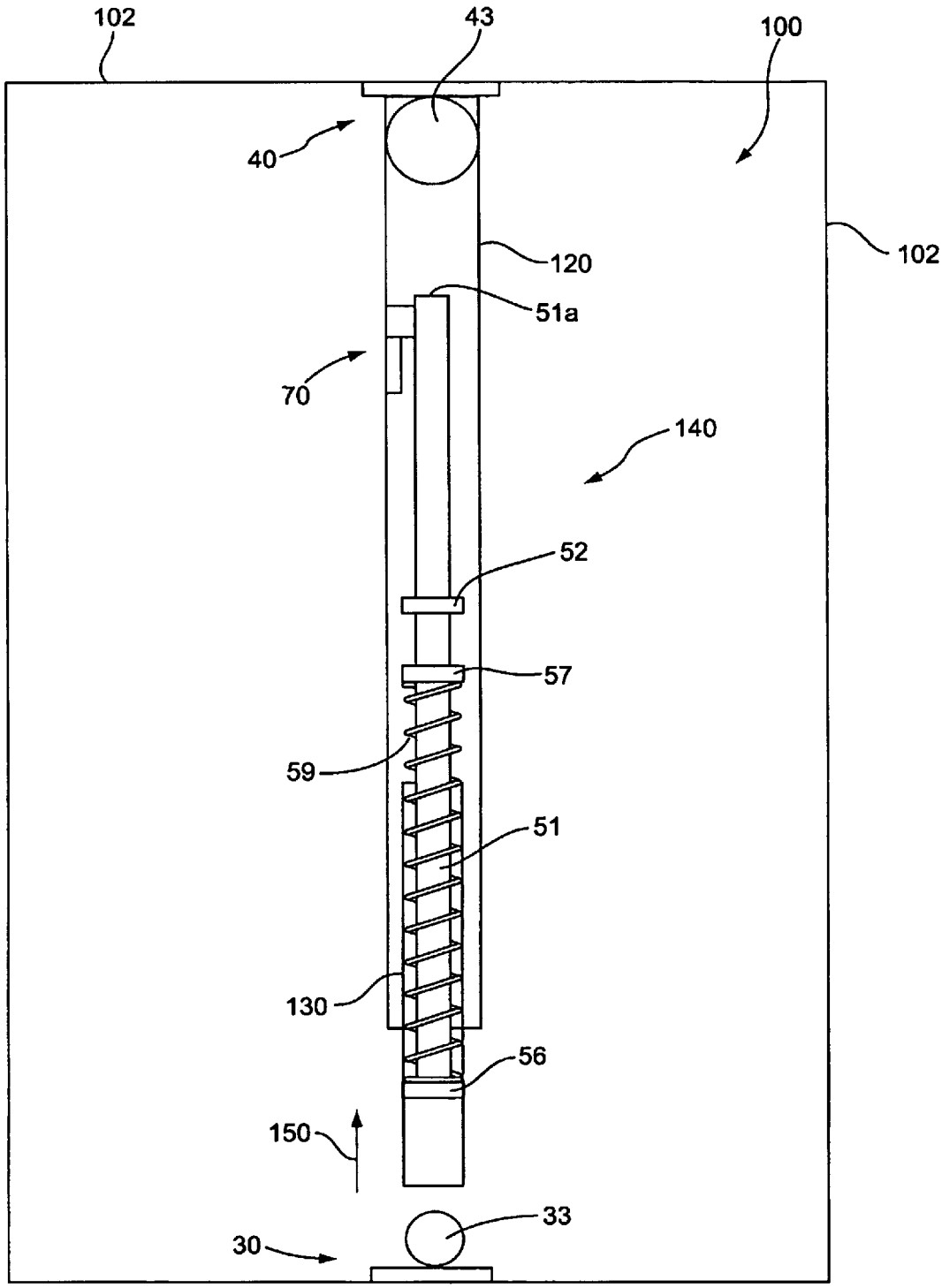
FIG. 6 is a side view illustrating one embodiment of the present invention with a first tube telescoping within a second tube.
Figure 7:
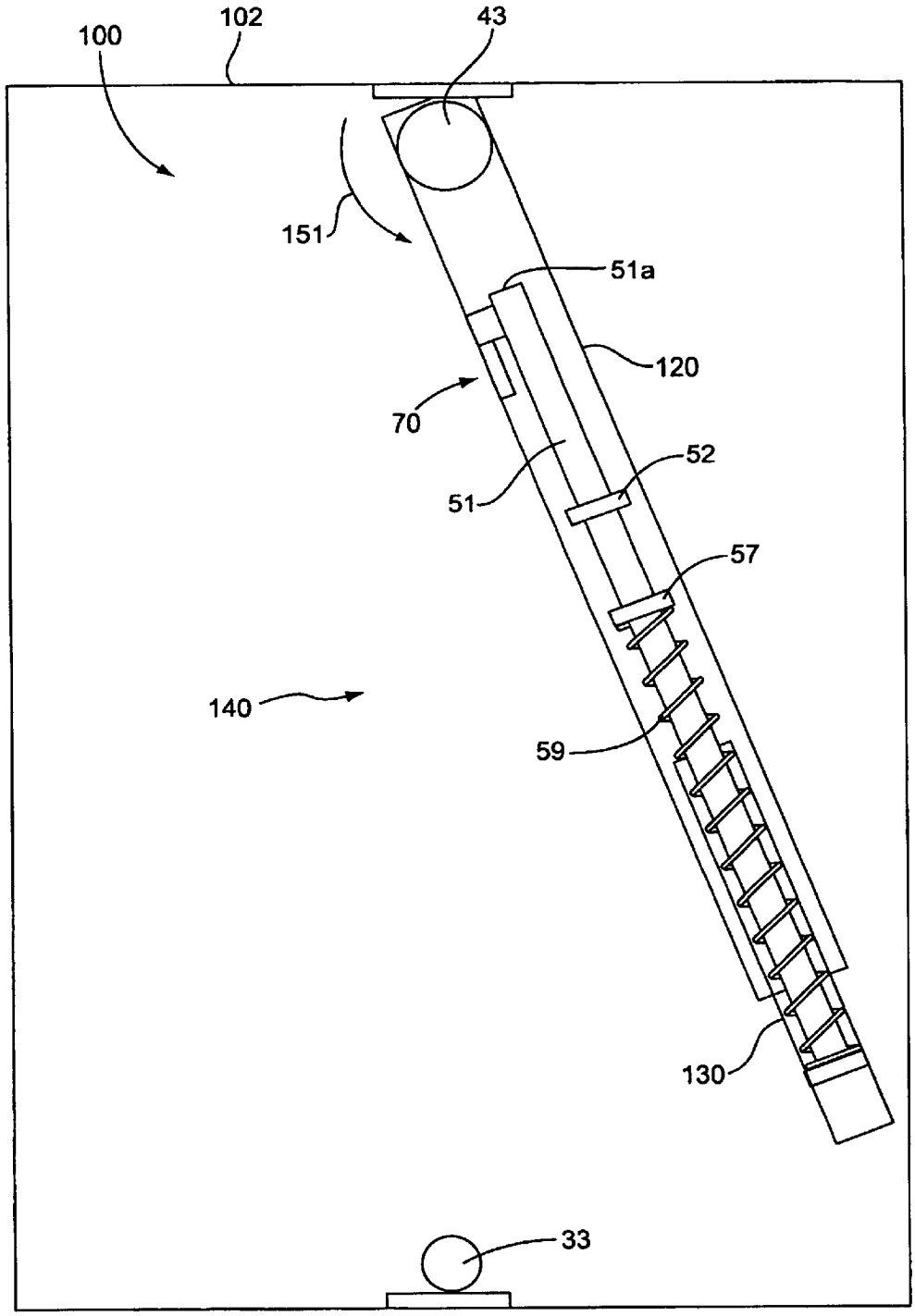
FIG. 7 is a side view illustrating one embodiment of the present invention with the first tube within the second tube and rotating about a mounting assembly.

One manner of using the removable mullion assembly is illustrated in FIGS. 5, 6, and 7. These figures illustrate a two-tube device, although it will be apparent that there are similarities in use of a three-tube device. FIG. 5 illustrates the tube 140 comprising first tube 120 and second tube 130 mounted within an opening 100. A frame 102 surrounds opening 100 and provides structure for mounting the first and second mounting assemblies 30, 40. The tube 140 is in the extended position that extends the entire distance between the frame 102 with one end of the tube positioned on mounting stud 43, and the second end positioned on mounting stud 33. The biasing member 59 biases the first tube 120 from the second tube 130. In one embodiment, the length of the tube 140 is controlled by the tube ends contacting the mounting assemblies 30, 40. In another embodiment, the length of the tube 140 is controlled with the guide stop 52 contacting the guide bracket 57. The locking mechanism 70 is activated with the armature 73 extending into the path of the guide rod 51. The position of the armature 73 from the lower edge 51*a* of the guide rod 51 is less than the width w of the mounting stud 33. This prevents the tube edge from becoming unattached from the mounting stud 33. The second edge of the tube 140 is mounted on the other mounting stud 43.

FIG. 6 illustrates the first tube 120 telescoping over the second tube 130. The locking mechanism 70 has been de-activated such that the armature 73 no longer blocks movement of the guide rod 51, and the guide rod end 51*a* can move beyond the armature 73. Pressure applied to the tube 130 in the direction of arrow 150 overcomes the force of the biasing member 59. This reduces the overall length of the tube 140 and separates the tube end from the mounting stud 33.

FIG. 7 illustrates removal of the tube 140 from the opening 100. The reduced length of the tube 140 provides for the two tube ends to be removed from the first and second mounting studs 33, 43. In one embodiment, first and second mounting studs 33, 43 both have a circular cross-sectional shape that facilitates rotation of the tube in a direction within the plane of the opening 100 as illustrated by arrow 151. Once rotated, the tube 140 can be lifted from the mounting stud 43 and removed from the opening 100.

The present invention may use a first mounting assembly 30 on both ends of the tube 20, a second mounting assembly 40 on both ends of the tube 20, or a combination. In one embodiment, the first mounting assembly is attached to an upper section of the opening 100 and a second mounting assembly 40 is attached to a lower section of the opening.

The tube may telescope in a variety of different orientations. In the embodiment illustrated in FIGS. 5, 6, and 7, the first tube 120 telescopes over the second tube 130. In another embodiment, the second tube 130 telescopes over the first tube 120. Likewise, the embodiment illustrated in FIGS. 1 and 2 features the second tube 22 positioned within the first tube 21 and the third tube 28. In another embodiment, the second tube 22 is positioned on the exterior of the first and third tubes 21, 28.

The telescoping portion of the tubes may be positioned at any point along the length of the device. In one embodiment, the telescoping portion is positioned at a first end of the device. In another embodiment, the telescoping portion is positioned at a second end of the device as illustrated in FIGS. 5, 6, and 7. In another embodiment, the telescoping portion is positioned within an interior section of the tube.

The present invention may be carried out in other specific ways than those herein set forth without departing from the scope and essential characteristics of the invention. In one embodiment, the guide rod 51 does not include a guide stop 52 to control the extent of extension of the tube. In this embodiment, the extent of extension results from the ends of the tube contacting either the frame 102 or first and second mounting assemblies 30, 40. The cross-sectional dimensions and shapes of the tube members may vary depending upon the application. Embodiments include rectangular, circular, and polygonal. The tube members may not each be the same dimension. One tube member may have a first shape, and a second tube member that mates together may have a second, different shape provided that the dimensions allow for telescoping. In one embodiment, the device is constructed of four telescoping tubes. The tube 20 may be removed from the opening 100 in a variety of manners including pivoting one end about a mounting assembly within the plane of the opening, pivoting one end about a mounting assembly perpendicular to the plane of the opening, and reducing the length of the tube 20 and detaching each end from the mounting assemblies. The present invention may extend vertically across an opening 100, horizontally, or at any angle as desired. The present invention may be constructed of a variety of materials. In one embodiment, the tubes 20, mounting assemblies 30, 40, guide rod 51, guide rod mount 56, and guide bracket 57 are constructed of steel. In one embodiment, the first tube is rectangular in shape and has an outer diameter of about 3 inches by 1.5 inches. In one embodiment, the length of the tube can be adjustable between about 7 feet and about 10 feet. The present embodiments are, therefore, to be considered in all respects as illustrative and not restrictive, and all changes coming within the meaning and equivalency range of the appended claims are intended to be embraced therein.

What is claimed is:

1. A removable mullion comprising:

a first tube;

a second tube in telescoping arrangement with the first tube, the first tube and the second tube being adjustable between an extended position having a first length, and a retracted position having a second length less than the first length;

a biasing member connected to each of the first tube and the second tube to bias the first tube outward from the second tube towards the extended position;

a guide rod attached to the first tube and extending through an interior section of the first tube and the second tube; and a locking mechanism positioned within the second tube adjacent to the guide rod, the locking mechanism being adjustable between a locked orientation that extends into the interior section of the second tube to block movement of the guide rod and prevent movement from the extended position to the retracted position, and an unlocked orientation that is positioned away from interior section of the second tube to provide movement from the extended position to the retracted position.

2. The device of claim 1, wherein the first tube and the second tube are hollow.

3. The device of claim 1, wherein the first tube further comprises a guide rod mount extending across the interior section of the first tube, the guide rod being mounted to the guide rod mount.

4. The device of claim 3, further comprising a guide bracket extending across the interior section of the second tube and fixedly mounted to the second tube, the biasing member having a first end positioned against the guide bracket and a second end positioned against the guide rod mount.

5. The device of claim 4, wherein the guide bracket further comprises an opening through which the guide rod extends, the opening being of a larger size than the cross-sectional dimension of the guide rod to allow movement of the guide rod through the opening when moving between the extended and retracted positions.

6. The device of claim 5, further comprising a guide stop positioned on the guide rod, the guide stop and guide rod having a combined cross-sectional dimension greater than the opening to prevent the guide rod and the guide stop from passing through the opening.

7. The device of claim 1, wherein the first tube and the second tube each have open outer ends sized to receive mounting assemblies positioned on the opening.

8. A removable mullion comprising:

a first tube;

a second tube in telescoping arrangement with the first tube, the first tube and the second tube being adjustable between an extended position having a first length, and a retracted position having a second length less than the first length;

a biasing member attached between the first tube and the second tube to bias the first and second tubes towards the extended position;

an elongated guide rod positioned within an interior of the first tube and the second tube, the guide rod having a first end attached to the first tube and a second end extending into the second tube; and a locking mechanism positioned within the second tube adjacent to the guide rod, the locking mechanism having an armature positionable between a first position to contact the guide rod second end and prevent adjustment from the extended position to the retracted position, and a second position away from the guide rod second end to allow the second end to move past the locking mechanism during adjustment from the extended position to the retracted position.

9. The device of claim 8, wherein the locking mechanism is positioned along the second tube at a position of the guide rod second end when the first tube is extended from the second tube.

10. The device of claim 8, wherein the locking mechanism further comprises a keyhole for insertion of a key to move the armature between the first position and the second position.

11. The device of claim 8, wherein the locking mechanism further comprises a member extending through the interior of the second tube and being attached to the armature, the member and the second tube being mated together such that rotation of the member results in the armature moving.

12. A removable mullion comprising:

a first tube;

a second tube in telescoping relation with the first tube;

a guide mount mounted within an interior of the first tube;

a rod having a first end attached to the guide mount and second end extending into an interior of the second tube;

a bracket mounted within the interior of the second tube and having an opening through which the rod extends;

a biasing member positioned between the guide mount and the bracket;

a stop mounted on the rod at a point between the second end and the bracket, the stop having a larger cross-sectional size than the opening; and a locking mechanism positioned within the second tube and having an armature positionable between a first position to contact the rod second end and a second position away from the rod second end.

13. The device of claim 12, wherein the first tube has an open first end to mount about a first mounting assembly positioned on a frame of an opening, the first mounting assembly having a rounded configuration.

14. The device of claim 12, wherein the second tube mounts on a second mounting assembly positioned on a bottom of an opening, the second mounting assembly comprising a bracket plate that attached to a frame of an opening, and a mounting stud that extends outward from the bracket plate to mount with a bottom end of the second tube, the mounting stud being detachable from the bracket plate.

15. A telescoping mullion for mounting within an opening comprising:

a first tube;

a second tube in telescoping relation with the first tube;

a third tube attached to the second tube;

a first mounting assembly attached to an edge of the opening and sized to receive an end of the first tube;

a second mounting assembly attached to an edge of the opening and sized to receive an end of the third tube;

a biasing member extending between the first tube and the second tube, the biasing member positionable between an extended orientation with the first tube is telescopically extended along the second tube, and a retracted orientation with the first tube telescopically retracted along the second tube, an overall tube length in the extended orientation being substantially equal to a distance between the first mounting assembly and the second mounting assembly, and the overall tube length in the retracted orientation being less than the first orientation.

16. The device of claim 15, wherein the first tube, second tube, and third tube each have a rectangular configuration.

17. The device of claim 15, further comprising a mount fixedly positioned within the first tube and a bracket fixedly positioned within the second tube, the biasing member having a first end positioned against the mount and a second end positioned against the bracket.

18. The device of claim 15, further comprising a guide rod attached to the first tube and extending into the second tube, and a locking mechanism positioned to contact an end of the guide rod, the locking mechanism positioned such that the end of the guide rod extends beyond the locking mechanism in the retracted orientation.

19. The device of claim 18, wherein the guide rod comprises a first end mounted to the first tube, and a second end that contacts the locking mechanism in the extended orientation.

* * * * *